United States Patent [19]

Smith

[11] Patent Number: 4,934,083

[45] Date of Patent: Jun. 19, 1990

[54] CHILD-PROOF LOCK FOR FIREARMS

[76] Inventor: C. Martin Smith, 10978 Ayres Ave., Los Angeles, Calif. 90064

[21] Appl. No.: 392,608

[22] Filed: Aug. 11, 1989

[51] Int. Cl.[5] ..... F41C 17/02

[52] U.S. Cl. ..... 42/70.07; 42/70.11

[58] Field of Search ..... 42/70.07, 70.11

[56] References Cited

U.S. PATENT DOCUMENTS

| | | |
|---|---|---|
| 835,349 | 11/1906 | Deming . |
| 1,686,482 | 10/1928 | Windle . |
| 2,512,140 | 6/1950 | Childs et al. . |
| 2,664,658 | 1/1954 | Bjorklund . |
| 2,742,726 | 4/1956 | Feller . |
| 2,859,551 | 11/1958 | Buchanan . |
| 2,893,152 | 7/1959 | Peluso . |
| 3,031,787 | 5/1962 | Womble, Jr. . |
| 3,139,694 | 7/1964 | Schaefer . |
| 3,422,560 | 1/1969 | Foote et al. . |
| 4,030,221 | 6/1977 | Doobenen et al. . |
| 4,392,318 | 7/1983 | Daniels . |
| 4,395,837 | 8/1983 | Durnal . |
| 4,412,397 | 11/1983 | Bayn . |
| 4,499,681 | 2/1985 | Bako et al. . |
| 4,644,676 | 2/1987 | Stern . |
| 4,723,370 | 2/1988 | Sheehan . |

*Primary Examiner*—Charles T. Jordan
*Assistant Examiner*—Richard W. Wendtland

[57] ABSTRACT

A detachable child-proof keyless lock is provided which fits over the trigger of a firearm to guard against the operation of the firearm by a child. The lock is constructed to fit firearms of various types and sizes. The lock is constructed so that when it is in place, it is absolutely impossible to fire the firearm.

7 Claims, 3 Drawing Sheets

CHILD-PROOF LOCK FOR FIREARMS

BACKGROUND OF THE INVENTION

Key operated trigger locks for firearms are known. U.S. Pat. No. 3,392,471, for example, discloses a trigger lock for a firearm which is key-operated and spring-loaded and which includes a pair of laterally separated side sections or covers, a ratchet lever, a sleeve with a series of teeth along one side of the sleeve, together with a suitable locking mechanism. The device may be adjusted to fit and clamp over the trigger guard areas of guns, pistols and other firearms, regardless of their size or shape. The trigger lock of the patent is intended to lock the trigger of the firearm against movement and consequently accidental discharge of the firearm.

However, the trigger lock described in U.S. Pat. No. 3,392,471 requires a key which may be lost, or if kept accessible, may be used by a child. Moreover, the trigger lock described in the patent includes a lock barrel which extends from one side of the trigger guard to the other across the trigger when the lock is in place. Under some circumstances should the lock assembly of the patent be worked loose on the trigger guard, it is conceivable that the trigger may be operated by the lock barrel, thus defeating the purpose of the lock.

An objective of the present invention is to provide a keyless lock for a firearm which is intended primarily to prevent the operation of the firearm by a child.

Another objective of the invention is to provide such a lock which is constructed so that no portion of the assembly extends through the trigger guard or across the trigger, so that it is absolutely impossible to operate the trigger when the lock of the invention is in place on the trigger guard.

SUMMARY OF THE INVENTION

A detachable keyless child-proof lock is provided which is constructed to be detachably mounted on the trigger guard of a firearm to encase the trigger and thereby guard against the discharge of the firearm by a child. The lock may be of the type utilized on many medicine bottles, in which the cap is threaded to the top of the bottle, but may only be removed if it is depressed and unthreaded at the same time.

DETAILED DESCRIPTION OF THE ILLUSTRATED EMBODIMENT

Figure 1:
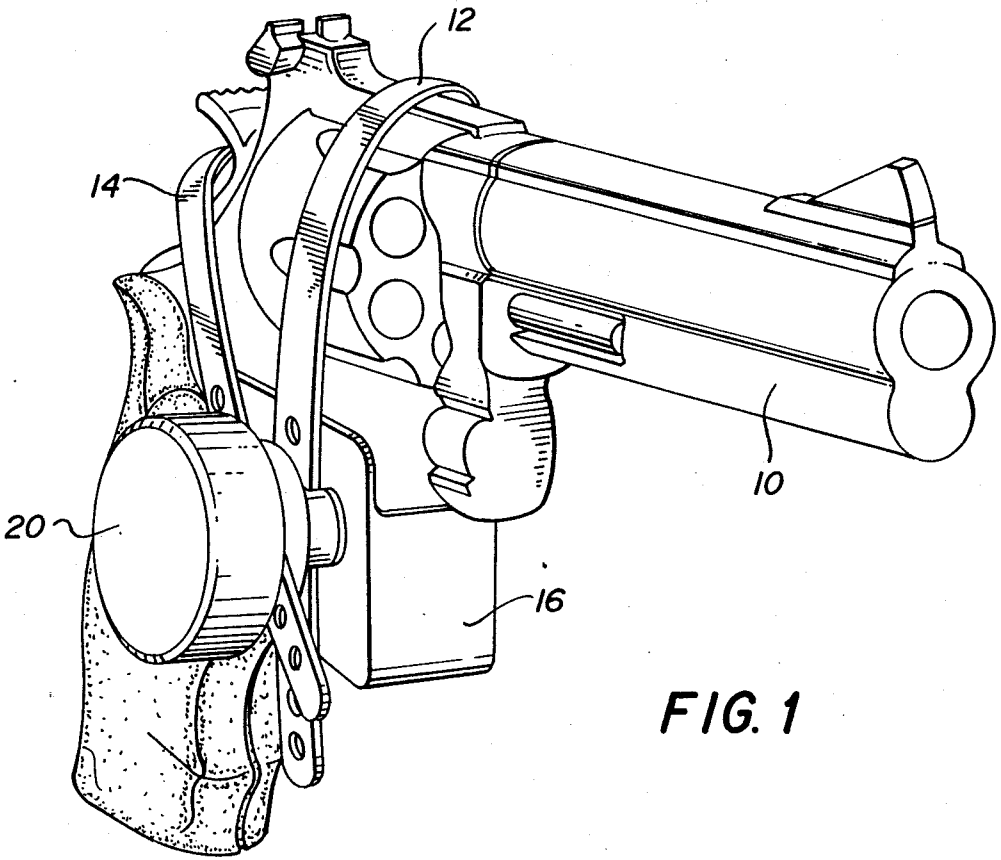
FIG. 1 is a perspective representation of a pistol in which a lock constructed in accordance with the present invention is mounted, so as to prevent the discharge of the pistol by a child.

As shown in the drawings, the lock assembly is intended to be used with firearms, such as the firearm 10 shown in FIG. 1. The lock assembly includes a bracket or housing 16 which may be formed, for example, of a molded plastic, and which has a generally rectangular configuration so as to fit over the trigger guard of firearm 10 of FIG. 1. The housing 16 has first and second side walls which have a generally rectangular configuration, and which are spaced and parallel to one another. When the housing is in place, the side walls extend over each side of the trigger guard of firearm 10. The housing 16 also has a molded end wall which may have a knockout construction so as to permit the housing to be fitted over firearms of different sizes and shapes.

Figures 2, 3:
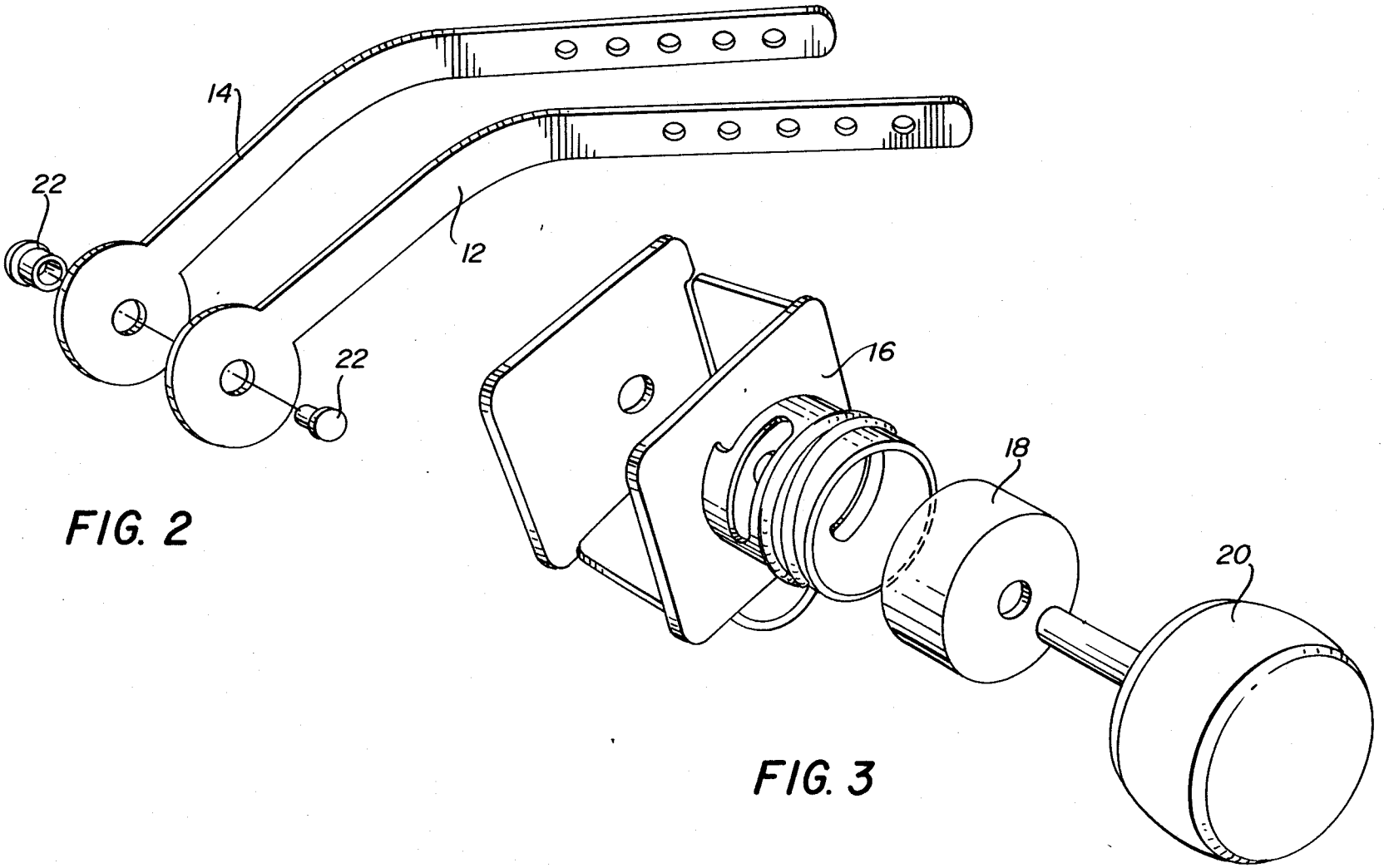
FIG. 2 is a perspective representation of a pair of straps which are used releasably detachably to mount the lock assembly of the invention on the firearm.
FIG. 3 is a detached perspective representation of certain components of the lock assembly used in the illustrated embodiment of FIG. 1.
Figure 4:
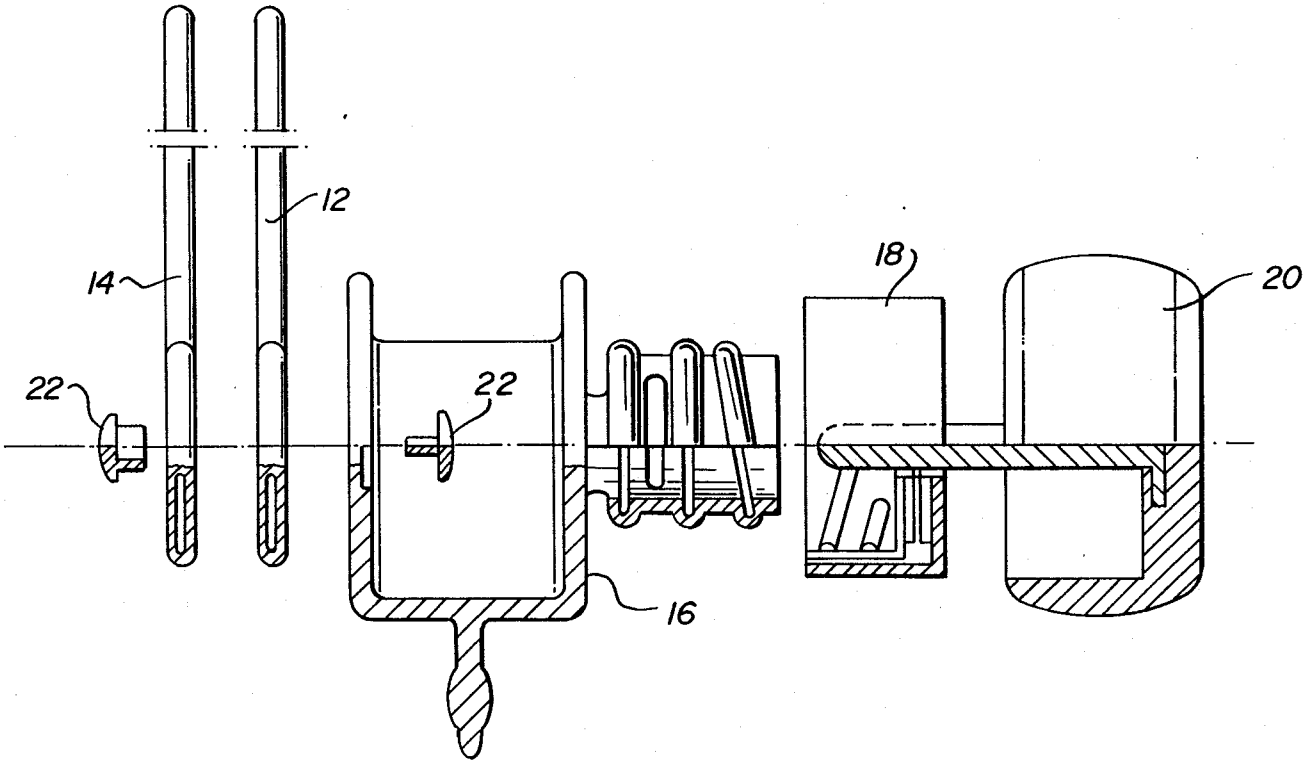
FIG. 4 is a detached side view of the various components of the lock assembly, shown partially in section.

As shown, for example, in FIGS. 3 and 4, housing 16 has a threaded socket portion formed on one of its side walls and extending outwardly from that side wall.

A pair of straps 12 and 14 are supported on the other side wall of housing 16 by rivets, such as rivets 22. Strap 14 forms the outside strap, and strap 12 forms the inside strap.

When housing 16 is in place on the trigger guard of the firearm 10, the straps 12 and 14 extend around the firearm, as shown in FIG. 1. The other ends of the straps extend into the socket portion of housing 16 and are secured by a tamper-proof cap 18 operating in conjunction with a cap cover and pin 20. The pin portion of the cap cover and pin extends through one of a plurality of holes in each of the straps 12 and 14 to secure the straps in place on the firearm 10, as shown in FIG. 1.

The pin portion of the cap cover and pin 20 extends to the bottom of the threaded socket portion of housing 16, but the pin does not extend into the housing. Accordingly, there is nothing in the housing between the side walls which could serve to operate the trigger when the housing is in place on the trigger guard.

As mentioned above, the cap 18 in conjunction with the socket portion of housing 16, together with the cap cover and pin 20, operate in the same manner as used on may tamper-proof medicine bottles. Specifically, the cap cover and pin 20 must be pressed into the cap 18, before the cap may be turned and unthreaded from the socket portion of housing 16.

The tamper-proof cap 18 may be a purchased part. The cap cover 20 may be formed of polycarbonate having a steel pin. Housing 16 may be molded polycarbonate. The straps 12 and 14 may be molded and each formed with a die cut steel core. Multiple holes are provided in the distal ends of straps 12 and 14 to enable the assembly to be mounted on firearms of different sizes and types. Rivets 22 may be formed of plastic and sonic welded in place, or may be formed, for example of aluminum.

The invention provides, therefore, a simple and sturdy lock assembly which is child-proof in its operation, and which is intended to fit over the trigger guard of a firearm so as to encase the trigger. The assembly serves to prevent the firing of the firearm by children. The assembly has a feature in that it is keyless, and also in that it provides an absolute protection against the firing of the firearm so long as the assembly is in place on the trigger guard.

It will be appreciated that while a particular embodiment of the invention has been shown and described, modifications may be made. It is intended in the claims to cover all modifications which come within the true spirit and scope of the invention.

I claim:

1. A trigger lock for a firearm constructed to be detachably mounted on the trigger guard of the firearm to prevent the operation of the firearm by children, said trigger lock comprising: a bracket having a first side wall and a second side wall spaced from one another and parallel to one another, the side wall being configured to fit over the trigger guard of a firearm on either side of the trigger guard so as to encase the trigger guard and to enclose the trigger of the firearm; at least one strap having a first end and a second end, said strap being secured at said first end to said first side wall of said bracket; and a cap assembly mounted on said bracket, said cap assembly including means engaging said second end of said strap to release said second end only upon a predetermined manipulation of said cap assembly so as to enable the strap to lock the bracket on the trigger guard until released by said cap assembly.

2. The trigger guard defined in claim 1, and which includes first and second straps each having a first end and a second end, and each secured at said first end to said first side wall of said bracket, and in which said means of said cap assembly engages said second end of each of said straps.

3. The trigger lock defined in claim 1, in which said cap assembly is detachably mounted on said bracket to be detached therefrom upon said predetermined manipulation of said cap assembly.

4. The trigger lock defined in claim 3, in which said bracket has a socket formed on said second side wall, and said cap assembly is threadably mounted to said socket.

5. The trigger lock defined in claim 4, in which said cap assembly includes securing means extending through said second end of said strap when said cap assembly is mounted on said socket.

6. The trigger lock defined in claim 5, in which said strap has a plurality of openings at said second end thereof for receiving said securing means to adapt the lock to firearms of different sizes.

7. The trigger lock defined in claim 6, in which said bracket is constructed to be adapted to fit over different sized trigger guards of different sized firearms.

* * * * *